US005373157A

United States Patent [19]

Hiroki et al.

[11] Patent Number: 5,373,157

[45] Date of Patent: Dec. 13, 1994

[54] QUADRUPOLE ELECTRODE AND PROCESS FOR PRODUCING THE SAME

[75] Inventors: Seiji Hiroki; Tetsuya Abe; Yoshio Murakami, all of Ibaraki; Yoshishige Takano, Hyogo; Akira Yamakawa, Hyogo; Masaya Miyake, Hyogo, all of Japan

[73] Assignees: Japan Atomic Energy Research Institute, Japan; Sumitomo Electric Industries, Ltd., Japan

[21] Appl. No.: 965,258

[22] PCT Filed: Sep. 7, 1992

[86] PCT No.: PCT/JP92/01141

§ 371 Date: Jan. 5, 1993

§ 102(e) Date: Jan. 5, 1993

[87] PCT Pub. No.: WO93/05532

PCT Pub. Date: Mar. 18, 1993

[30] Foreign Application Priority Data

Sep. 11, 1991 [JP] Japan ..... 3-231658
Sep. 12, 1991 [JP] Japan ..... 3-233055

[51] Int. Cl.[5] ..... H01J 1/88

[52] U.S. Cl. ..... 250/292; 250/281; 313/256

[58] Field of Search ..... 313/256; 250/281, 290, 250/292, 293; 427/126.2; 29/592.1, 825

[56] References Cited

U.S. PATENT DOCUMENTS 3,553,451 1/1971 Uthe ..... 250/292
4,700,069 10/1987 Ino et al. ..... 250/292
4,885,500 12/1989 Hansen et al. ..... 250/292
5,266,824 11/1993 Abe et al. ..... 257/347

FOREIGN PATENT DOCUMENTS 63-152846 6/1988 Japan ..... H01J 49/42
02220344 9/1990 Japan ..... H01J 49/22

*Primary Examiner*—Jack I. Berman
*Assistant Examiner*—James Beyer
*Attorney, Agent, or Firm*—Jordan B. Bierman

[57] ABSTRACT

The present invention relates to improvement of a quadrupole electrode for use in a mass spectrometer or the like, in which two pairs of electrode rods 1, 2, 3 and 4 formed in such a manner that the section of the opposed face of each rod is hyperbolic or circular, and each electrode rod is made of a ceramic and the surface of the electrode is coated with a coating layer 5 of a conductive metal. Further, the present invention relates to a production process, characterized by incorporating such four electrodes at predetermined intervals. Since the electrodes are mainly made of a ceramic which is easily formable with a high dimensional accuracy, the adjustment of the positional relationship between the electrodes during assembling can be made without much effort, which enables a quadrupole electrode having a high performance to be provided with a good reproducibility at a low cost.

10 Claims, 4 Drawing Sheets

QUADRUPOLE ELECTRODE AND PROCESS FOR PRODUCING THE SAME

TECHNICAL FIELD

The present invention relates to a quadrupole electrode for use in the sensor part of a mass spectrometer or the like.

BACKGROUND ART

A quadrupole electrode used in a mass spectrometer of the like comprises four electrodes 11, 12, 13 and 14 formed in such a manner that opposed surfaces are hyperbolic in their cross section as shown in FIG. 4, or four electrodes 11', 12', 13' and 14' formed so as to have a circular cross section as shown in FIG. 5 are disposed in a positional relationship adjusted so that the electrodes are located at predetermined intervals. When ions are fed into the center of the quadrupole electrode in the direction indicated by an arrow, it becomes possible to take out ions having a particular mass to charge ratio with a high accuracy from the opposite side of the quadrupole electrode. In such a conventional quadrupole electrode, the distance between the electrode rods should be kept so accurately that a very highly accurate work is required in assembling the quadrupole electrode and a long time are necessary for the assembly and adjustment of the quadupole electrode. Further, a change in the distance between the electrodes caused during the analysis should be minimized.

For example, Japanese Patent Laid-Open No. 30056/1983 describes the use of an electrode produced by subjecting a metallic material to extrusion or drawing into a V-shaped electrode for the purpose of reducing the weight of the electrode and, at the same time, improving the dimensional accuracy. Further, Japanese Patent Laid-Open No. 87743/1984 and Japanese Utility Model Laid-Open No. 64562/1985 describe the shape of electrode rods which are easy to assemble into a quadrupole electrode. Further, other various designs have been proposed in the art.

In the conventional quadrupole electrode, in order to bring the accuracy of the distance between the constituent electrodes to a predetermined value, it is a common practice to use a method which comprises manually assembling a quadrupole electrode, introducing a monitor gas for confirming the accuracy and repeating a check on the accuracy to correct the distance between the electrodes. According to the present invention, the constituent electrodes can be disposed with a high dimensional accuracy without any such troublesome work and the predetermined accuracy of the distance between the electrodes can be kept high during the use thereof.

The present invention provides a quadrupole electrode comprising two pairs of opposed electrodes, characterized in that the electrode rods are constituted of electrode rods which are made of an insulating ceramic and coated with a conductive metal, and are previously fixed with a predetermined dimensional accuracy.

The section of the opposed face of each electrode is a hyperbolic or circular. The ceramic constituting the electrode rod has a coefficient of thermal expansion of $9(\times 10^{-6}/°C.)$ or less, more preferably a coefficient of thermal expansion of $4(\times 10^{-6}/°C.)$ or less.

The present invention provides a process for producing a quadrupole electrode which comprises incorporating the above-mentioned four electrodes at predetermined intervals in such a manner that two pairs of the electrodes are arranged opposite to each other. In the production, the four electrodes are jointed to each other directly or through a jig.

Thus, the present invention has been made with a view to facilitating the formation of a quadrupole electrode with a high accuracy and a good reproducibility. In the present invention, a high accuracy within $\pm 5\ \mu m$ can be attained in the distance between the electrodes and a change in the distance between the electrodes during the use thereof in the analysis can be minimized by using an insulating ceramic having a low coefficient of thermal expansion and subjected to high-accuracy working as the material of the electrode and, after coating the surface of the electrode with a conductive metal, assembling four electrodes, and incorporating the resultant quadrupole electrode in a mass spectrometer.

In order to improve the accuracy of assembling a quadrupole electrode and, at the same time, to shorten the time necessary for the adjustment of the accuracy, it is necessary to assemble at once the electrodes into a quadrupole electrode through reference planes finished with a predetermined accuracy. When a metal is used as the material of the electrode, however, there occurs a problem that the insulation between the electrodes cannot be maintained. This problem can be solved through the use of an insulating ceramic. Since ceramic has a low coefficient of thermal expansion and a light weight, it is advantageous in that the dimensional stability against a change in the temperature can be maintained and improved and the handleability is good. A ceramic having a coefficient of thermal expansion of $9(\times 10^{-6}/°C.)$ or less suffices for this purpose, and use may be made of $Si_3N_4$, sialon, mullire, SiC, AlN, $Al_2O_3$, cordierire, quartz, etc.

BEST MODE FOR CARRYING OUT THE INVENTION

Figure 1:
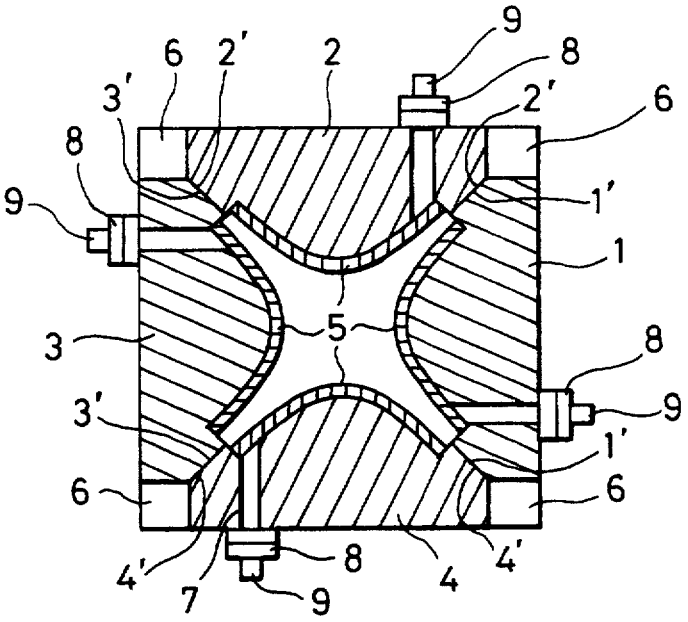
FIG. 1 is a cross-sectional view of one embodiment of the present invention.

The invention will now be described in more detail with reference to FIG. 1. Numerals 1, 2, 3 and 4 designate four electrodes previously subjected to high-accuracy working, and the body of each electrode rod is made of a ceramic. Although the ceramic may be any one as far as it has an insulating property and a low coefficient of thermal expansion, it is particularly important that the coefficient of thermal expansion be small. The present inventors have made intensive studies through the use of various ceramics and, as a result, have found that a coefficient of thermal expansion of $9(\times 10^{-6}/°C.)$ or less suffices for this purpose and $Al_2O_3$, SiC, mullire, quartz, sialon, AlN, cordierire and $Si_3N_4$ are effective. As a result of further detailed studies on these ceramics, it has been found that an $Si_3N_4$ ceramic having a coefficient of thermal expansion of $4(\times 10^{-6}/°C.)$ or less is preferred. This is because the distance between the electrodes of the quadrupole electrode of a mass spectrometer where a high resolution is required is as large as at least 20 mm and, in this case, a change in the distance between the electrodes with the elapse of time is believed to affect the accuracy of analysis.

The use of a $Si_3N_4$ ceramic electrode having a low coefficient of thermal expansion enables the distance between the electrodes to be kept with an accuracy as high as $\pm 5$ μm, that is, the analytical accuracy to be sufficiently maintained, even when use is made of a quadrupole electrode having a large distance between the electrodes.

Numeral 5 designates a conductive metal layer formed for coating the surface of the ceramic therewith for the purpose of allowing the ceramic to function as an electrode. The formation of the metal layer enables the insulating ceramic to function as the electrode. The metal layer may comprise any conductive metal, and it is also possible to use a single phase composed of Mo, W, Au, Pt, Ti, Cu, Ag, Ni or the like or an alloy or a composite phase composed of these materials. The thickness is preferably 1 mm or less. When the thickness exceeds 1 mm, there is a possibility that peeling occurs unfavorably. The coating may be conducted through the formation of a thin film according to a vapor deposition process or coating according to the wet paste method. If necessary, the metallized layer may be machined to maintain the accuracy.

An electrode terminal can be formed by passing a conductive lead wire through a hole 7 of each of the electrode rods 1, 2, 3 and 4 for conduction to a conductive metal layer formed on the hyperbolic surface of the ceramic electrode rod. The lead wire is fixed with a nut 8. Thus, four ceramic electrodes are formed independently of each other. These electrodes can be assembled with a high accuracy by fixing reference planes 1', 2', 3' and 4' of the electrodes to each other by lapping and jointing the electrodes to each other directly or through a jig 6 such as a chip. The jointing is conducted through the use of an active metal layer for a ceramic, fine particles of a ceramic, or the like.

Thus, it has become possible to facilitate assembling of four ceramic electrodes each made of a ceramic coated with a conductive metal into a quadrupole electrode with a high accuracy. In the drawing, numeral 9 designates a lead wire.

EXAMPLE 1

Figure 2:
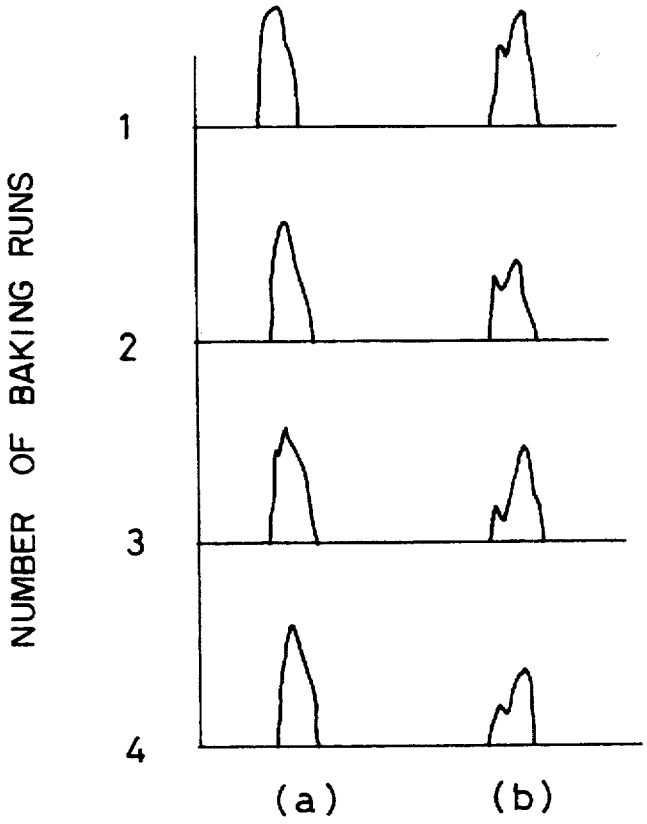
FIG. 2 is a graph showing the results of measurements of scattering of the peak waveforms in a mass spectra given by a mass spectrometer.
Figure 3:
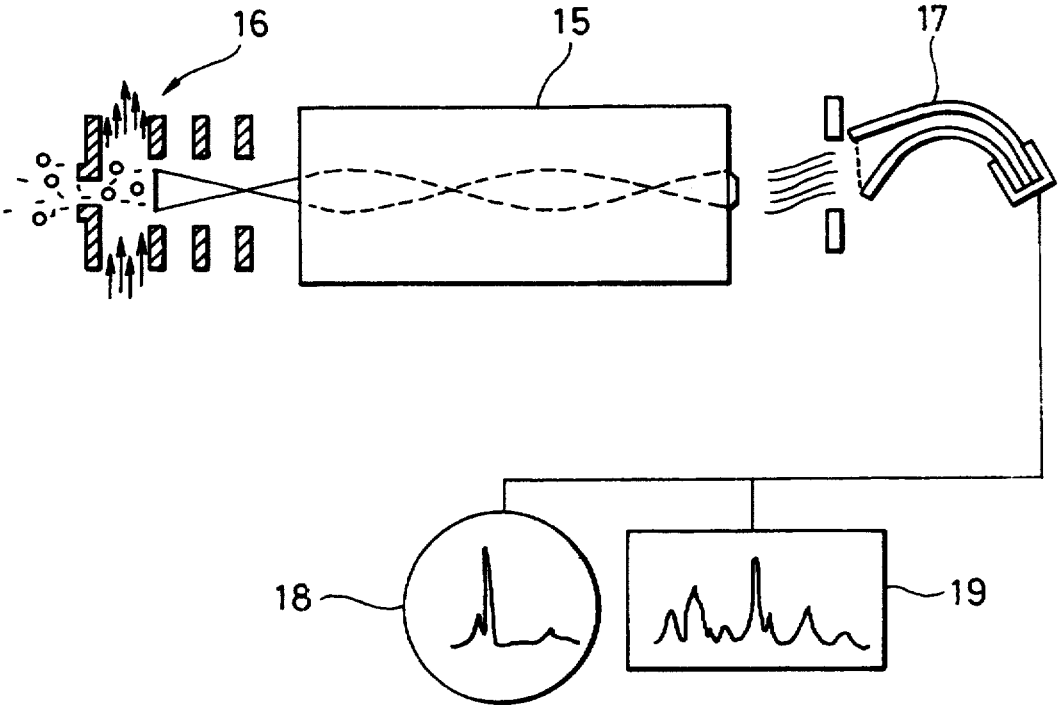
FIG. 3 is an explanatory view of an embodiment wherein the electrode of the present invention is incorporated in a mass spectrometer.
Figure 4:
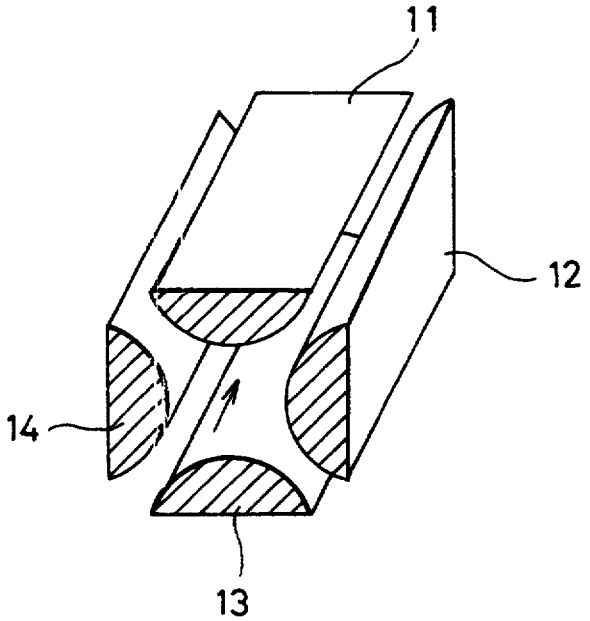
FIG. 4 is an explanatory perspective view of one construction of the conventional quadrupole electrode.
Figure 5:
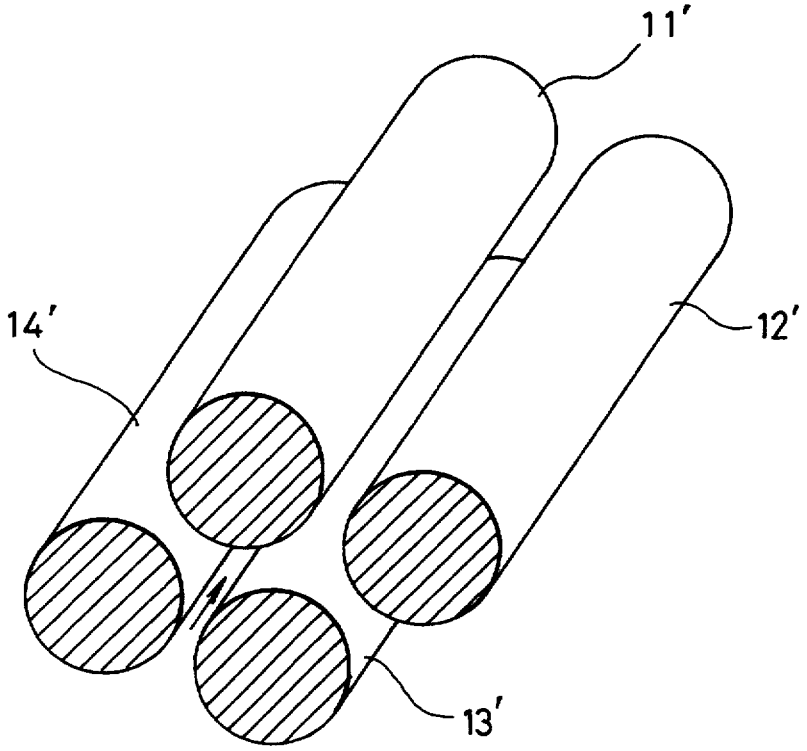
FIG. 5 is an explanatory perspective view of another construction of the conventional quadrupole electrode.

An electrode body having a distance between the opposed electrodes of 8.6 mm and a length of 200 mm was made of an $Si_3N_4$ ceramic material having a coefficient of thermal expansion of $3.2\times 10^{-6}/°C.$ as a ceramic material, and the hyperbolic face thereof was machined with a high accuracy. Thereafter, an active metal (Ti-Cu-Ag) was deposited thereon in a thickness of 5 μm, and Ni was further deposited thereon in a thickness of 1 μm to form electrodes. These electrodes were assembled into a quadrupole electrode as shown in FIG. 1. As shown in FIG. 3, an ion source 16 for forming ions was mounted on one end of the quadrupole electrode 15, while a secondary electron multiplier 17 for detecting ions was mounted on the other end thereof. Numerals 18 and 19 designate an oscilloscope and a pen recorder, respectively. This assembly was incorporated as a quadrupole mass spectrometer in an ultrahigh vacuum apparatus where it was baked at 300° C. Thereafter, He, $N_2$, Ar, Kr and Xe gases were flowed, and this procedure was repeated several times to measure a scattering in the peak waveform of a mass spectrum. FIG. 2 shows the measurement results in which numbers, i.e., 0, 1, 2, 3, 4 and 10, are the numbers of baking runs.

As a result, the peak waveform of the quadrupole mass spectrometer, in which a conventional metal electrode (Mo electrode) was used, was in the split parabolic form as shown in FIG. 2(*b*). Also, the scattering of the peak height was large. This scattering of the peak waveform is believed to be attributable to the scattering of the dimensional accuracy. On the contrary, the peak waveform of the quadrupole mass spectrometer, in which the $Si_3N_4$ ceramic quadrupole electrode was used, was in the parabolic form as shown in FIG. 2(*a*), and scarcely any scattering of the peak height was observed. Thus, the use of the $Si_3N_4$ ceramic quadrupole electrode has made it possible to simplify the assembling and adjustment of the electrode and maintain a high analytical accuracy.

EXAMPLE 2

$Si_3N_4$ ceramic electrode rods for forming a quadrupole electrode having a distance between the electrode rods of 8.6 mm and a length of 200 mm was machined into a predetermined shape having a predetermined dimension, which was then subjected to finish working so that the section became hyperbolic.

The hyperbolic part was coated with Ti, Cu, Ag and Ni each in a thickness of 1 μm by ion plating to form a conductive film having a thickness of 4 μm in total. A Kovar rod of 1.6ϕ was inserted into a hole previously formed in each electrode and then the electrodes were joined and fixed by means of an active metal solder.

The four $Si_3N_4$ ceramic electrodes were fixed one to another with the reference planes thereof abutting against each other and soldered to each other with an active metal solder via $Si_3N_4$ chips (jigs, 6), $5\times 5$ in area and 10 mm long, in a jointing furnace under the conditions of 800° C. and 10 min.

The time taken for the assembling was 10 hr, and the accuracy of the distance between the electrodes in the assembling was within $\pm 5$ μm, which enabled the assembling time to be remarkably reduced. The quadrupole electrode thus assembled was incorporated in a vacuum apparatus, where baking was repeated ten times at 300° C. Then, the scattering of the peak waveform in a mass spectrum was measured. It was found that the waveform was parabolic as shown in FIG. 2(*a*) and no scattering of the peak height was observed. On the contrary, the peak waveform given by the conventional metal (Mo) quadrupole electrode was in the split parabolic form as shown in FIG. 2 (*b*) and the scattering of the peak height was significant.

INDUSTRIAL APPLICABILITY

In the present invention, since each electrode rod is mainly made of a ceramic which is easily shaped with a high dimensional accuracy, the adjustment of the positional relationship between the electrodes during assembling can be made without much effort, which enables a quadrupole electrode having a high performance to be provided with a good reproducibility. Further, since a ceramic is used as the main material, it is possible to provide a quadrupole electrode having a light weight at a low cost as opposed to a quadrupole electrode wherein Mo or stainless steel is used as the main material.

We claim:

1. A quadrupole electrode comprising two pairs of opposed electrodes, each electrode being formed of an insulating ceramic and comprising an inner surface which faces an inner surface of the opposing electrode, and mating surfaces formed to mate with corresponding mating surfaces of adjoining electrodes, a portion of said inner surface being coated with a conductive metal whereby said portion of said inner surface does not contact said portion of said adjoining electrodes, said mating surfaces being formed whereby, when said quadrupole electrode is assembled, each said coated portion will be maintained a predetermined distance from an opposing coated portion.

2. The electrode of claim 1 wherein said inner surface is hyperbolic.

3. The electrode of claim 1 wherein said inner surface is circular.

4. A quadrupole electrode according to claim 1, wherein the ceramic constituting said electrode rod has a coefficient of thermal expansion of $9(\times 10^{-6}/°C.)$ or less.

5. A quadrupole electrode according to claim 1, wherein the ceramic constituting said electrode rod is an $Si_3N_4$ ceramic having a coefficient of thermal expansion of $4(\times 10^{-6}/°C.)$ or less.

6. A process for producing a quadrupole electrode comprising incorporating two pairs of opposed electrodes, each electrode being formed of an insulating ceramic and comprising an inner surface which faces an inner surface of the opposing electrode, and mating surfaces formed to mate with corresponding mating surfaces of adjoining electrodes, a portion of said inner surface being coated with a conductive metal, whereby said portion of said inner surface does not contact said portion of said adjoining electrodes, said mating surfaces being formed whereby, when said quadrupole electrode is assembled, each said coated portion will be maintained a predetermined distance from an opposing coated portion.

7. The process of claim 6 wherein said inner surface of each electrode is hyperbolic.

8. The process of claim 6 wherein the inner surface of each electrode is circular.

9. The process of claim 6 wherein said electrodes are joined to each other directly.

10. The process of claim 6 wherein said electrodes are joined to each other through a jig.

* * * * *